US005368012A

United States Patent [19]

Chamberlain

[11] Patent Number: 5,368,012

[45] Date of Patent: Nov. 29, 1994

[54] WALL FURNACE WITH SIDE VENTED DRAFT HOOD

[75] Inventor: Albert B. Chamberlain, Colton, Calif.

[73] Assignee: Williams Furnace Company, Colton, Calif.

[21] Appl. No.: 192,955

[22] Filed: Feb. 7, 1994

Related U.S. Application Data

[63] Continuation of Ser. No. 917,826, Jul. 21, 1992, abandoned.

[51] Int. Cl.[5] ..... F24H 3/00; F24H 3/02; F24H 3/12

[52] U.S. Cl. ..... 126/116 B; 126/116 C; 126/110 R; 126/110 AA; 126/307 A

[58] Field of Search ..... 126/99 R, 116 R, 85 B, 126/110 R, 116 B, 116 C, 307 A, 110 AA, 109

[56] References Cited

U.S. PATENT DOCUMENTS

| | | | |
|---|---|---|---|
| 2,277,201 | 3/1942 | Belt | 126/307 A |
| 2,484,292 | 10/1949 | Hermanson | 126/523 X |
| 2,556,944 | 6/1951 | Rhyner | 126/307 A |
| 2,572,888 | 10/1951 | Stein | 126/528 X |
| 2,602,441 | 7/1952 | Hollingsworth et al. | 126/116 B |
| 2,792,826 | 5/1957 | Kilbury | 126/116 B X |
| 2,818,059 | 12/1957 | Cayot | 126/116 B X |
| 2,834,279 | 5/1958 | Thompson | 126/116 B |
| 3,258,004 | 6/1966 | Bedell et al. . | |
| 3,295,749 | 1/1967 | Bedell et al. . | |
| 3,601,118 | 8/1971 | Hein | 126/307 A |
| 4,434,823 | 3/1984 | Traeger | 126/116 C X |
| 4,784,110 | 11/1988 | Skafte et al. | 126/109 X |

FOREIGN PATENT DOCUMENTS

| | | | |
|---|---|---|---|
| 569561 | 1/1959 | Canada | 126/116 B |
| 691519 | 7/1964 | Canada | 126/116 B |
| 1126957 | 9/1968 | United Kingdom | 126/116 B |
| 1199321 | 7/1970 | United Kingdom | 126/116 B |

*Primary Examiner*—Carl D. Price

*Attorney, Agent, or Firm*—Knobbe Martens Olson & Bear

[57] ABSTRACT

A wall furnace is disclosed in which a secondary heat exchanger is provided to maximize the heat transfer efficiency of the furnace. The secondary heat exchanger faces the room to be heated but is aligned directly behind the primary heat exchanger. The length of the secondary heat exchanger is shortened as compared to the combined length of the combustion chamber and primary heat exchanger so as to reduce inefficiencies due to reheating of the combustion gases and to promote air flow and heat transfer around the secondary heat exchanger. Thus, this configuration provides for two essentially separate circulation circuits for heat transfer and maximum furnace efficiency. Separate heated air deflectors are also provided for each of these circuits. A side venting draft hood is also disclosed.

17 Claims, 4 Drawing Sheets

WALL FURNACE WITH SIDE VENTED DRAFT HOOD

This application is a continuation of application Ser. No. 07/917,826, filed Jul. 21, 1992, abandoned.

FIELD OF THE INVENTION

This invention relates to a heating apparatus, and more particularly to an improved gravity flow wall furnace.

BACKGROUND OF THE INVENTION

Gas-energized, gravity flow wall furnaces have been widely used for many years to provide heat for one or two rooms, typically in structures not having central heating. These furnaces are usually partially recessed into a wall in the space between two studdings in a conventional stud wall. Such space is normally only about 14⅜ inches wide. The furnace must also be very shallow. Since a conventional stud only provides a space of about 3½ inches in depth, the furnace usually extends only another 6–7 inches into the room. As a result of these dimensional constraints, and because of costs, many such wall furnaces do not have a fan and rely only on gravity for the flow of room air and combustion products. That is, the cool room air sinks and the warm room air and the hot combustion gases rise. Some furnaces, which rely primarily on gravity for the flow of the room air across the surface of the exchanger, also have a blower to redirect the heated air which is flowing upward due to gravity.

Current wall furnaces typically include a thin, flat, wide heat exchanger extending vertically in the wall, with the edges of the exchanger being positioned adjacent to, but spaced from, the studs in the wall. Air is drawn into the combustion chamber of the furnace and just past the burner port level. It is drawn into the flame by a natural entrainment or aspirating action. The flame jet, surrounded by a mixture of combustion products and secondary air, forms a recirculatory vortex which is drawn up along the boundary of the flame, and then down along the combustion chamber wall. The cause of this recirculation is a combination of the effects of initial vertical velocity of the gas-air mixture issuing from the burner, its expansion due to its increase in temperature as it burns and the buoyancy of the heated mixture relative to surrounding cooler gases. In this recirculation zone, the temperature of the combustion chamber walls is increasing to a certain maximum. A maximum wall temperature is reached at approximately the interface between the recirculation zone and a parallel flow zone. From this point on, the system functions substantially as a parallel flow heat exchanger and the combustion gases are ducted upwardly through the primary exchanger section.

The room air to be heated flows through a grill, forming the wall of the furnace facing the room. Cool room air enters the furnace near the lower end of the heat exchanger, is heated from the exterior of the heat exchanger, and flows upwardly due to a decrease in density caused by heating, and exits back into the room at the upper end of the heat exchanger. With this simple arrangement, fairly effective heat transfer is obtained.

Typically, the highest thermal efficiency provided by such gravity flow wall furnaces has been about 70%. This roughly means that the combustion process itself is fairly complete, and that at steady state about 70% of the heat from the combustion gases is transferred into the room. An alternative measure of heat transfer efficiency is the annual fuel utilization efficiency ("AFUE"). Typical gravity flow wall furnaces attain an AFUE of approximately 63–64%.

U.S. Pat. No. 4,784,110 discloses an improvement over the above gravity flow wall furnaces in which two secondary heat exchangers are positioned adjacent the main heat exchanger and combustion chamber combination. Thus, increased flow path, and therefore heat exchange area, is obtained by defining a tortuous path for the combustion gases. The secondary heat exchangers comprise sections or legs of the path extending side by side between the studdings in a conventional stud wall. The main combustion chamber is in the center of the two secondary exchangers. The disclosed improvement obtains an overall greater heat exchange area, but decreases the surface area directly facing the room to be heated. Further, all three exchanger sections are of identical length. Thus, the flue gases in the secondary exchangers are reheated to some extent by heat transfer from the adjacent combustion chamber. Although this design represents a significant improvement over standard wall furnaces, further improvements are possible.

Typical heat exchangers represent a trade-off between gas flow velocity and heat exchange surface area to obtain the maximum heat transfer. The combustion gases must flow upwardly through the heat exchanger with sufficient velocity to ensure that adequate air is drawn into the burner to provide sufficient oxygen and to produce a continued flow. At the same time, it is desirable that the velocity of the combustion gases be sufficiently slow and the surface area of the exchanger be sufficiently large to maximize the heat transfer from the heat exchanger.

The combustion gases of the typical furnace exits the structure through a flue spaced within the structure walls. In order to prevent overheating of the structure walls and avoid any potential fire hazard, the flue gases must be below a certain maximum temperature. The furnace must also minimize any down draft from the flue, which would adversely affect the burner operation. To this end, typical gravity flow wall furnaces include draft hoods at the top of the exchangers. The draft hoods collect flue gases and allow them to expand. The expansion in the draft hood results in some decrease in temperature of the flue gases, thereby decreasing the velocity of the flue gases and increasing their pressure. Thus, the risk of a down draft from the exterior is minimized.

The draft hood, however, needs to be vented to provide further cooling and to provide a secondary outlet for flue gases in the event the flue is blocked by an obstruction. Current wall furnaces locate the draft hood vents on the front of the draft hood. This vent location reduces the efficiency of the furnace by allowing some already heated room air to enter the vent and be discharged through the flue without heating the room.

In the operation of gravity flow furnaces, absent a deflector, the heated room air will generally rise to the top of the room. Even with deflectors, there is some degree of stratification of the hot and cool air. Accordingly, some gravity flow wall furnaces use blowers to direct the heated air out into the room. The blower is usually located at the top of the unit, just above the draft hood. The blowers are normally of a lower power variety than, for example, the blowers of the forced air type wall furnace, since they merely redirect air which is already circulating over the exchangers by the operation of gravity.

The blowers necessarily must be placed at the front of the exchanger in order to direct the heated air out into the room. This placement of the blower interferes with the operation of the vents on the draft hood, i.e., the blower is directing air out into the room and the vent is drawing air from the room. Thus, the increase in velocity created by the blower decreases the pressure in front of the vent, thereby decreasing the amount of air drawn in through the vents. These redirecting blowers are to be distinguished from the fans of forced air type furnaces, which are generally much more powerful and usually force air downward over the exchangers and out of the bottom of the unit into the room.

In recent years, a further requirement involving conservation of energy has been governmentally mandated. This was primarily imposed with respect to forced air, central, gas heating systems, but the regulations have been extended to be applicable as well to wall furnaces. The 70% thermal efficiency ratings of current commercial wall furnaces barely satisfy this requirement. The Department of Energy was to determine by January 1992 whether efficiency requirements were to be increased. Although the Department of Energy has not yet acted, it is anticipated that more stringent requirements may be proposed. It is expected that current wall furnaces will not meet a more stringent efficiency requirement, since most barely meet current requirements.

Thus, a need exists for an improved heat exchanger for a wall furnace that will improve efficiency, conserve energy and meet the various standards anticipated. The standards must be met based on a gravity flow system, i.e., without the use of a blower to circulate room air or a fan to induce draft for the combustion process. Of course, blowers can be used to further increase the efficiency of the furnace. Further, any such improvement must also be practical and inexpensive in order to be competitive from a marketing standpoint.

SUMMARY OF THE INVENTION

The present invention provides an economical means to improve the efficiency of previous design gravity flow wall furnaces. This has been accomplished in a wall furnace that still fits within the conventional space constraints of standard wall furnaces.

The improved wall furnace includes a secondary heat exchanger located behind the primary exchanger. That is, the secondary heat exchanger is arranged with respect to the primary heat exchanger such that it is closer to and slightly recessed into the wall. However, as explained below in more detail, a flow channel behind the primary heat exchanger and in front of and around the secondary heat exchanger is advantageously provided. Both the location of this secondary heat exchanger and its length, among other features of the present invention, represent improvements in the design of gravity flow wall furnaces. By locating the secondary exchanger behind the primary exchanger, the improved furnace maintains the maximum amount of surface area facing the room and increases the overall surface available for heat transfer.

A significant feature of the invention is the length of the secondary exchanger. Its length is less than that of the combustion chamber/primary exchanger combination. In the preferred form of the invention this length is in the range of approximately 54% of the length of the combustion chamber/primary exchanger combination. This has been found to be optimum in terms of efficiency. The secondary exchanger is not so long that it too closely approaches the maximum temperature point of the combustion chamber. This minimizes any reheating of the flue gases in the secondary exchanger. Any such reheating would increase the flue gas temperature and decrease efficiency. Also, this arrangement leaves a wide rear channel available for the flow of room air behind the combustion chamber. This rear channel, in addition to the front, main channel which flows in front of the combustion chamber, maximizes the flow of cool room air over and around the combustion chamber section, which is the hottest portion of the unit and therefore the most efficient heat transfer source.

It is a further advantage of the present invention that, since the flue gases do not flow along an overly extended or tortuous path, there is sufficient momentum to the flow of the gases even though the heated gas, which is less dense that the surrounding air, is directed downwardly as it flows through the first channel of the secondary exchanger. This maximizes the intake of air into the combustion chamber.

Another advantage of the present invention is the use of two air deflectors to channel the flow of heated air into the room. It should be noted that the placement of the deflectors above the exchanger sections allows for the creation of two circulation currents of heated room air, one flowing in front of the unit and a second, in the back, flowing around the combustion chamber and the secondary heat exchanger. As a result, the front and back currents can operate without substantial interference from each other. This is important because the front current is naturally more forceful since it is exposed to a greater amount of room air. The placement of the upper deflector also insulates the draft hood from the heat exchanger section of the furnace by providing a dead air space below it.

A significant feature of the invention has been accomplished by the use of a side venting draft hood. This feature minimizes the amount of heated air which is drawn away from the room and vented out of the flue. The purpose of the draft hood is to collect flue gases, allow them to expand, thus resulting in an increase in pressure, which both protects against the down draft from the exterior and decreases the temperature of the flue gases. Cooling the flue gases prior to exit is necessary to avoid overheating the walls of the structure in which the flue is located. In typical furnaces, the draft hood vent faces toward the front of the unit and receives primarily heated internal air from the wall furnace or heated room air which has just passed over the exchangers. The side location of the vents thus provides increased cooling of the flue gas.

The use of a side venting draft hood is not limited to use with secondary exchangers. The side vents provide equally beneficial flue gas cooling in other wall furnaces, whether or not the furnace utilizes a secondary exchanger.

The location of the vents on the side of the draft hood allows for a further improvement in the furnace in the placement of a redirecting blower above the draft hood. The blower can then redirect the heated air out into the room without interfering with the venting of the draft hood. The optional blower is primarily used to redirect the heated air which is already circulating within the furnace by operation of gravity. Thus, it need not be very powerful and does not consume significant power.

The use of the optional blower can also further increases the cooling of the flue gases in the draft hood since it results in the expulsion into the room to be heated of warm internal air surrounding the draft hood. Such expulsion also improves the efficiency of the present furnace. This beneficial placement of the blower resulting from the side venting draft hood is also not limited to use in furnaces with secondary exchangers.

The use of the redirecting blower also allows for the addition of an optional electrical resistance heating element in the blower assembly. This can be used as an alternative heat source when it is inconvenient or impractical to use the gas burner. For example, in the summer months the pilot for the gas burner is often off, and rather than lighting the pilot for certain especially cool nights, one can utilize the electrical heating element.

Finally, the invention is designed so as to fit within the standard envelope for wall furnaces. Thus, no retrofitting or additional construction is necessary to replace an old furnace with the new one exhibiting these inventive features. Further, both the combustion chamber/primary exchanger section and the secondary exchanger section can be removed as a unit, or separately, for replacement, cleaning or servicing.

DETAILED DESCRIPTION OF THE INVENTION

Figure 1:
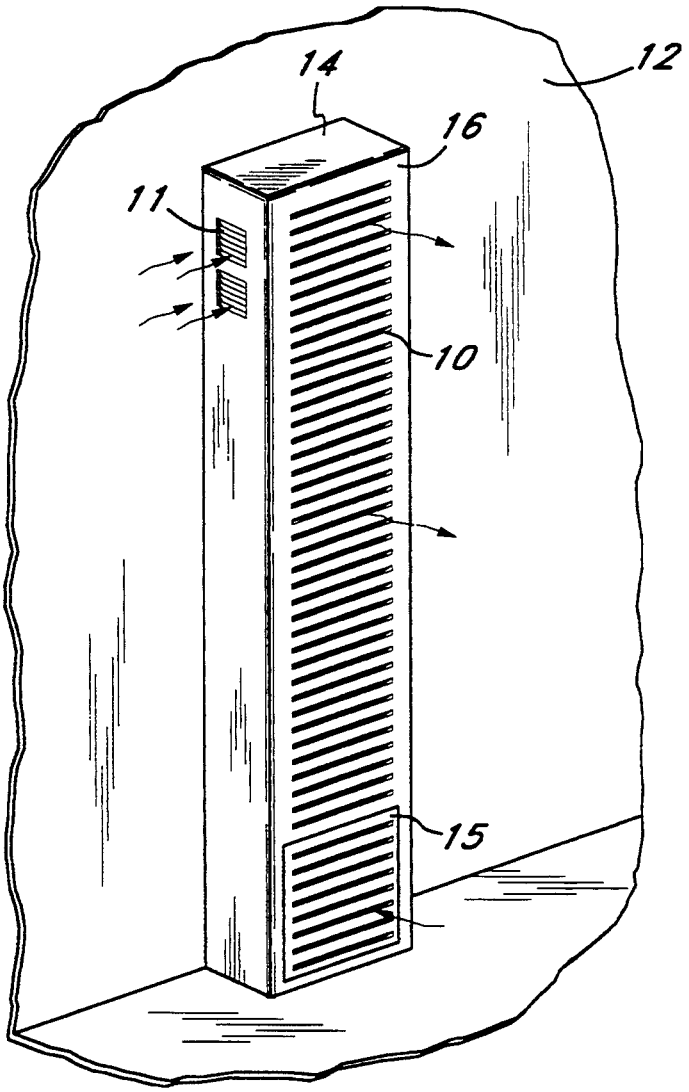
FIG. 1 is a perspective view of a furnace incorporating the invention, with the furnace being installed in a standard, partially recessed manner within a wall.

In FIG. 1, the wall furnace 10 of the invention may be seen to be recessed in a wall 12, but having an outer shell 14 extending into the room and a front louvered cover or grill 16 for room air flow. Thus, warm or heated air exits the furnace 10 through the grill 16, as shown by the arrows in FIG. 1. On the other hand, room air to be heated enters the furnace 10 through the air intake grill or return 15 shown at the lower portion of the furnace in FIG. 1. As explained below in more detail in connection with FIGS. 2–3, room air also enters the furnace through the side louvres 3, 11 (one side shown in FIG. 1) and into the side vent(s) 36 of the draft hood 22, which are best shown in FIGS. 2 and 3.

It will be understood that the wall furnace of the present invention is installed in a conventional stud wall between the wall studdings in a standard fashion, and that such installation is within the abilities of one of ordinary skill. However, the advantages of the present invention are not limited to standard wall furnaces installed in this manner but are equally applicable to other types of furnaces which are installed and utilized in other ways.

Figure 2:
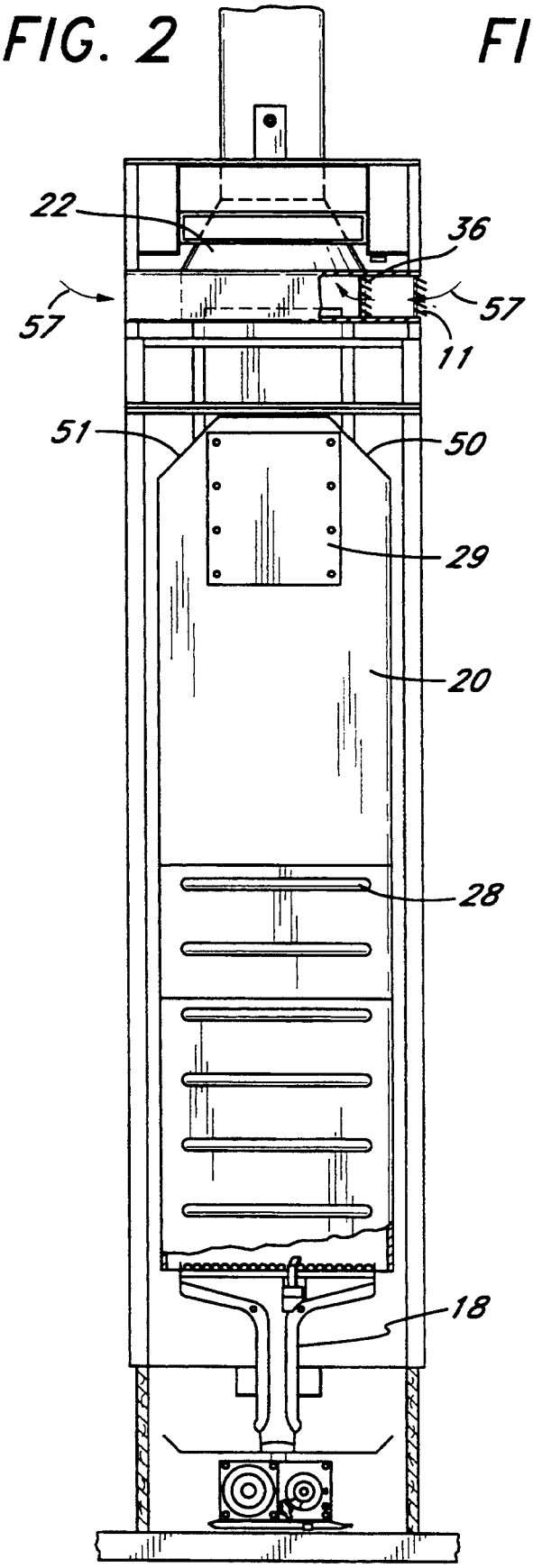
FIG. 2 is a front elevational view of the furnace with portions cut away to illustrate particular features of the present invention.

Referring specifically to FIG. 2, there is shown the furnace 10 of the present invention including a burner 18 located at the lower end of the unit, combustion chamber section 25, a heat exchanger assembly 20, and a draft hood 22 leading to a flue 24 which extends upwardly and spaced within the conventional wall studdings.

Figure 3:
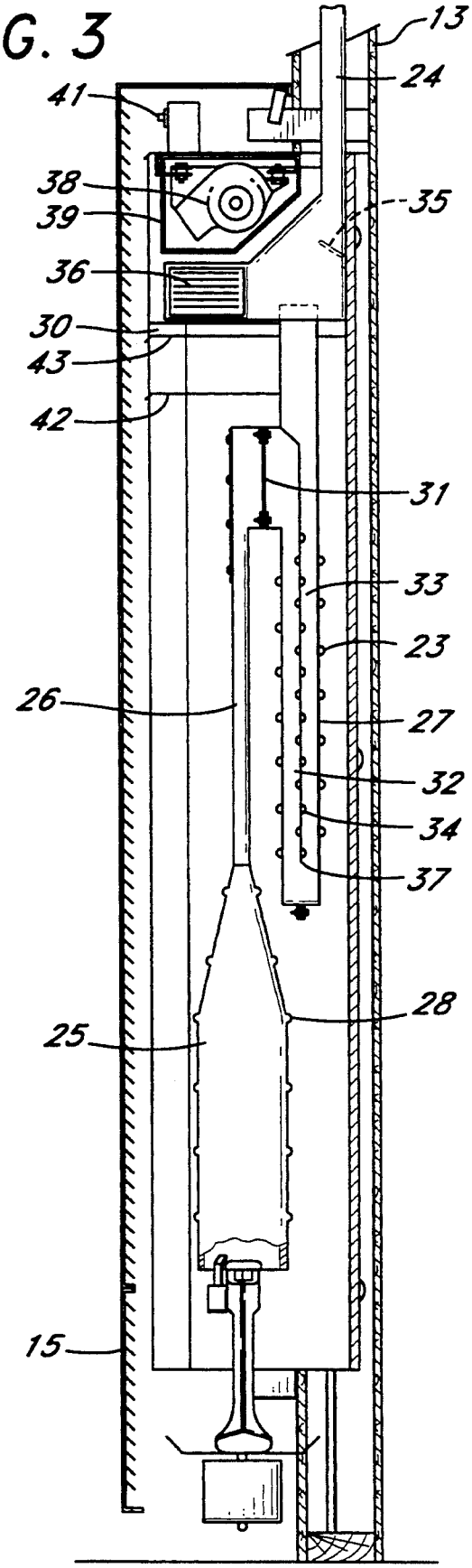
FIG. 3 is a side elevational view of the furnace recessed in a wall, with the wall shown in cross section.

Referring to FIGS. 2 and 3, the heat exchanger assembly 20 consists of a combustion chamber section 25, a primary heat exchanger section 26 located above the combustion chamber, and a secondary heat exchanger section 27 located behind the primary exchanger (FIG. 3). Of course, the combustion chamber section 25 also functions to exchange heat with circulating room air. For ease of reference, however, it is merely referred to as a combustion chamber 25. Each of these three sections have the same dimension in the direction parallel to the wall 13, i.e., the width or face of the unit. Thus, although the width of the secondary exchanger 27 is not illustrated in FIGS. 2 or 3, it will be understood that such width is substantially the same as the primary exchanger section 26. Optimally, this width dimension is as great as is reasonably practicable considering the dimensional constraints of the wall in which the furnace is located. This arrangement is desirable in order to have the maximum heat transfer surface area facing the room to be heated. In one embodiment of the present invention, the width dimension of these components is approximately 11½ inches.

As can be seen from FIG. 2, the combustion chamber 25 has the largest dimension perpendicular to the wall (depth) in order to both better accommodate the burner 18, which, as may be seen from FIG. 2, is positioned partially within the lower end of the combustion chamber 25, and to withstand the increased pressure and turbulence of the gases in the combustion chamber. In a production form of the invention the combustion chamber is approximately 4½ inches deep at its greatest depth. The combustion chamber 25, as seen in FIGS. 2 and 3, has ribs 28 in order to increase the turbulence of the contacting room air, thereby increasing the heat transfer rate. The secondary exchanger 27 has similar ribs 23. As the combustion chamber extends upwardly it narrows in depth until it reaches the primary exchanger 26. In a production form of the invention the depth of the primary exchanger is approximately 1 inch.

The upper end of the primary exchanger section 26 extends back towards the wall 13 for connection to the secondary exchanger section 27. The upper ends of the primary and secondary exchanger sections are flanged for removable connection to each other. The two flanges are bolted together with a gasket 31 suitable for high temperature uses. The front face of the primary exchanger 26 has an opening covered by removable plate 29 in order to allow easy access to the inside of the exchangers. Such an assembly is easily removed for servicing and repairs.

The distance between the primary exchanger 26 and secondary exchanger 27 should attempt to minimize the amount to which the furnace extends into the room to be heated, but not so small as to inhibit the flow of air between the two sections. In a production form of the invention they are spaced approximately in the range of 1½–2 inches apart. The upper corners 50 and 51 of the primary exchanger 26 are truncated, rather than at right angles. This allows for better flow of heated air between the primary and secondary exchangers 26 and 27. In other words, heated air circulating in the rear circuit around the secondary exchanger has a reduced likelihood of being trapped behind the primary exchanger, since it can be drawn, through the truncated corners 50 and 51, into the primary flow circuit. This truncated configuration of the corners also improves the flow of combustion gases from the primary exchanger 26 to the secondary exchanger 27 by eliminating dead spots in the corners.

Separating the front and rear walls of the secondary exchanger 27 is a divider wall 37. This divider wall 37 extends for most of the length of the secondary exchanger 27 to direct the flue gases first down a first channel 32 and then up a second channel 33. The divider wall is preferably formed with protrusions or ribs along its surface 34 in order to increase the turbulence of the flowing flue gases, thereby increasing contact with the exchanger walls and the rate of heat exchange to the walls and from the walls to the circulating room air.

As best seen in FIG. 3, the secondary exchanger 27 does not extend the full length of the heat exchanger assembly 20. In this regard, the heat exchanger assembly 20 may be regarded as the combination of the lengths of the combustion chamber 25 and the primary exchanger 26. Rather, in the preferred form of the invention, the secondary exchanger 27 extends approximately 22 inches, based on an overall length of 41 inches for the heat exchanger assembly 20, or 54% of the overall length; however percentages in the range of 47 to 56 are suitable to achieve the advantages of the present invention. This arrangement is an important feature of the invention. The arrangement minimizes heat transfer from the combustion chamber 25 to the secondary exchanger 27, which would decrease the overall efficiency of the furnace. This is done by extending the exchanger no further than the point of maximum temperature in the combustion chamber 25. Although limiting the length of the secondary exchanger limits surface area for heat transfer, which would be expected to decrease efficiency, the secondary exchanger actually provides optimum overall efficiency by providing increased draft and minimal reheating of flue gases by the combustion chamber. Furthermore, as explained below in more detail in connection with FIG. 5 and 6, this arrangement also provides a sufficient flow channel for heated room air behind the combustion chamber 25.

As seen in FIG. 3, the second channel 33 of the secondary exchanger 27 opens up at its upper end to allow for some expansion of the flue gases in the draft hood inlet prior to entry into the draft hood 22. The draft hood inlet extends a short distance into the draft hood 22 to assure that it does not slip out. The draft hood 22 is provided with a deflector 35 to prevent the flue gases from flowing directly out the flue. This assists in maximizing the expansion/cooling of the flue gases in the draft hood 22.

As further seen in FIG. 3, the draft hood is also provided with vents 36 located on either or both sides to allow for room air 57 to be drawn into the hood 22 to maintain the flue temperature below a certain maximum. As shown in FIG. 3, the vents 36 are located on the side of a portion of the draft hood extending out beyond the wall 12, allowing for ease of communication of air between the draft hood and room through vents 11 on the side wall of the wall furnace and vents 36 on the draft hood. The location of these vents on the side of the draft hood form an important feature of this invention. Since the room air enters from the side, as can be best seen in FIG. 2, the air is cooler than the air which would enter the hood 22 from the front, thereby increasing the cooling effect on the flue gases and minimizing any lost heating efficiency due to the venting of already heated room air.

The side location of the draft hood vents 36 also allows for the optimum use of a redirecting blower 38 if one is so desired. FIG. 3 shows the blower assembly 39 located just above the draft hood 22 and bolted to the top of the furnace 10. In the preferred form of the invention, the blower 38 is a typical electrically operated tangential or cross flow blower and is ideally directed at a 30 degree angle from horizontal.

Figure 4:
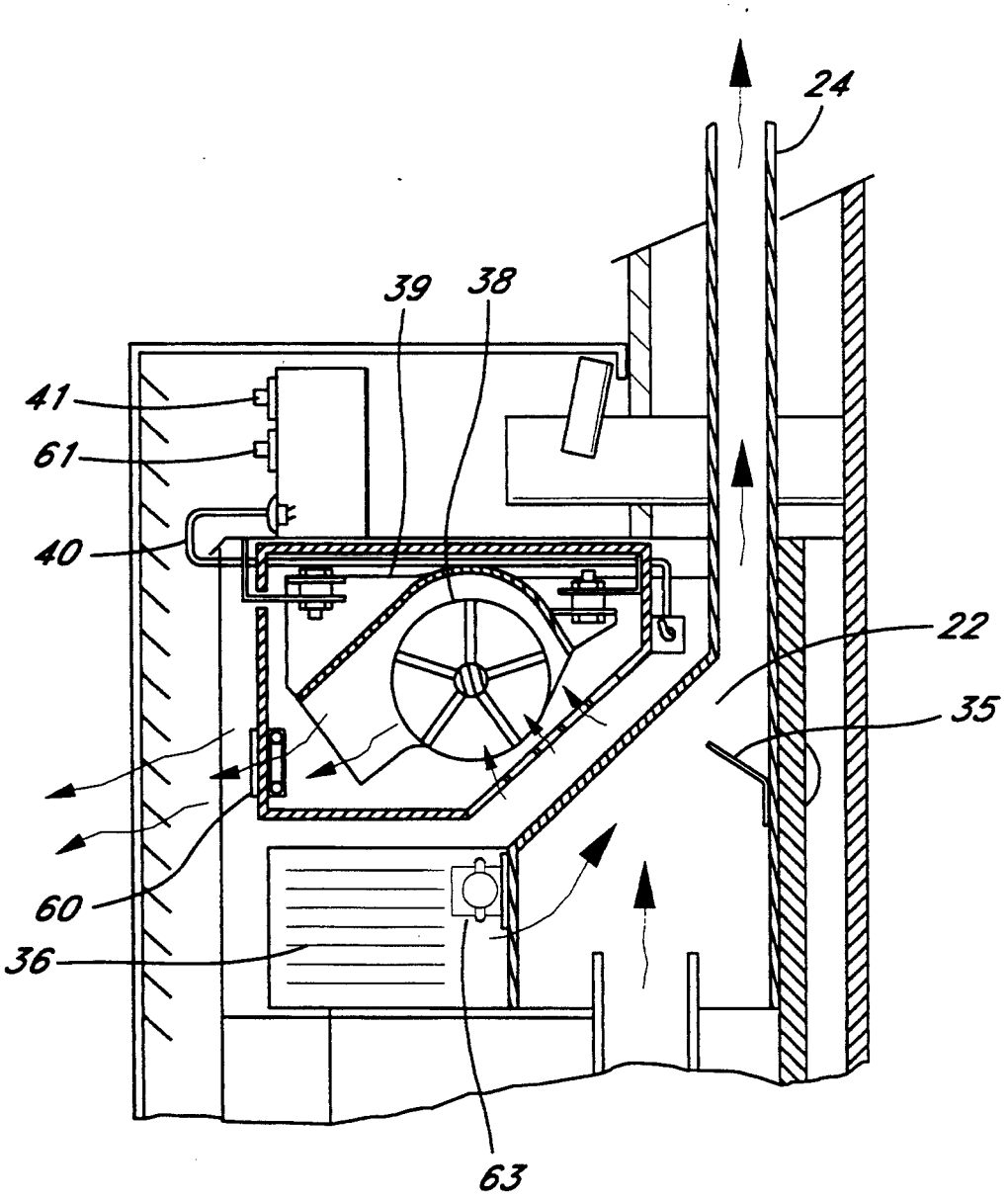
FIG. 4 is a side cross-sectional view, illustrating the draft hood and optional blower assembly in more detail.

FIG. 4 shows a temperature sensor 40 located in the blower assembly 39. A capillary tube type temperature sensor 40 is shown in the preferred form of the invention. The sensor 40 detects that the burner 18 is operating and causes blower 38 to be activated. The blower of the preferred form of the invention has a two-speed switch 41, which is manually operated by the user depending on his or her preference. However, it will be recognized that various types of blowers and temperature sensors can be utilized with equal success in connection with the principles of the present invention.

FIG. 4 also shows the redirecting blower assembly with an optional electrical resistance heating element 60. The electrical resistance heating element 60 is operated by on/off switch 61 located above the blower assembly 39. FIG. 4 also shows a conventional vent limit switch 63, which turns the burner 18 off if the flue becomes blocked.

Figure 5:
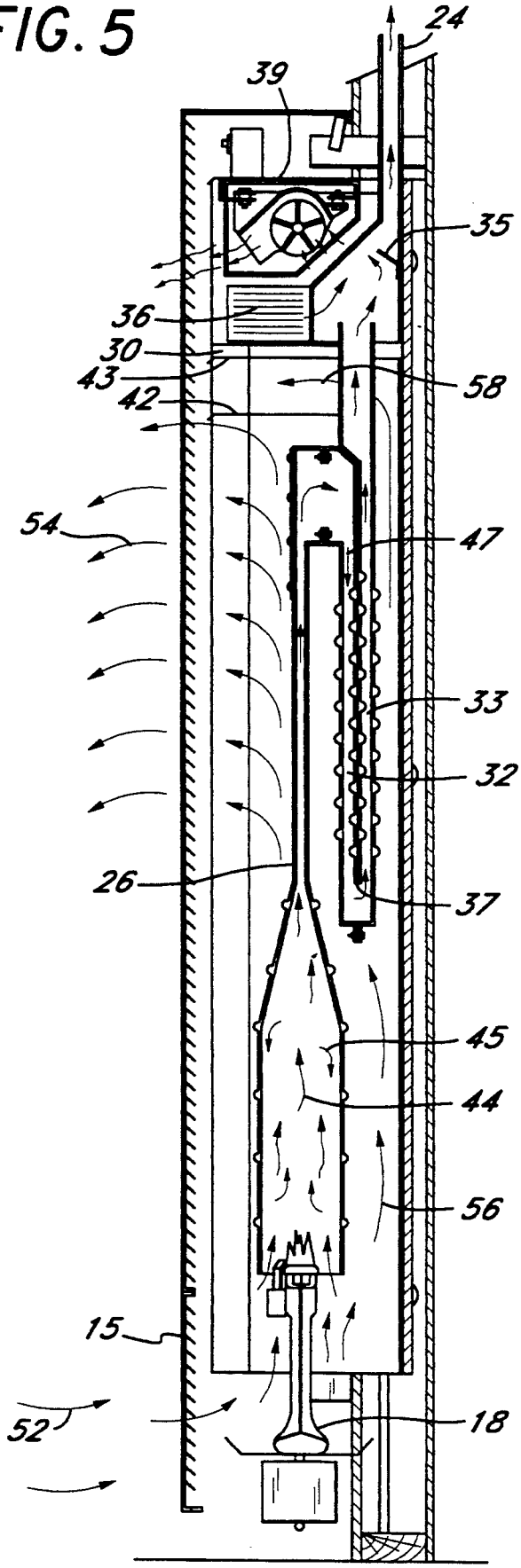
FIG. 5 is a side elevational view of the furnace insert of FIG. 3 schematically illustrating the flow of combustion products and room air.
Figure 6:
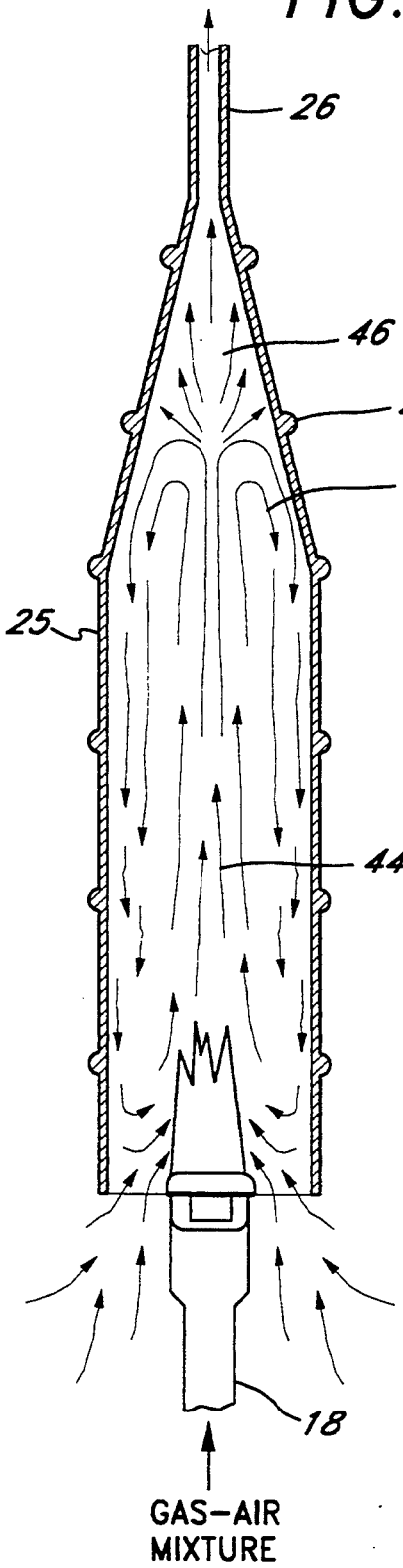
FIG. 6 is a side cross-sectional view, schematically illustrating the flow of combustion products in the combustion chamber in more detail.

FIGS. 5 and 6 illustrate the deflector plates 42 (lower) and 43 (upper) located just below the draft hood 22. The deflector plates 42 and 43 force the heated air out into the room to be heated. The lower deflector plate 42 deflects the air circulating in the front of the unit 54, whereas the upper deflector plate 43 deflects air rising from the back of the furnace 58. These deflectors are positioned so that the front and back circulating currents 54, 58 do not interfere with each other. The deflectors further isolate the draft hood 22 from the heated air to maximize its cooling effect by creating a dead space 30 between the upper deflector 43 and the draft hood 22.

A radiation shield (not shown) may be provided around the lower ends of the heat exchanger to maintain the temperature of the stud walls surrounding that area of the furnace at a satisfactory level.

OPERATION

The operation of the unit is shown best by FIGS. 5 and 6. In operation, gas provided to the burner 18 is ignited in the lower end of the combustion chamber section 25. Room air is drawn in through the return 15 of the furnace 10, into the burner itself for premixing of air and gas. Additional room air is drawn in through the lower end of the combustion chamber, through the space surrounding the burner 18. The combustion products form a turbulent vortex, as indicated by arrows 44 and 45. The kinetic energy of the gases is dissipated by fluid friction losses in the vortex resulting in decreased turbulence. From this point on, the hot combustion products are ducted upwardly in a parallel flow manner, as indicated by the arrows 46 in FIG. 6. As further seen from FIG. 5, the heat exchanger forms an elongated flow path for the combustion products, which longer than the straight line path to the hood 22 or the flue 24. More specifically, the combustion chamber section 25 of the heat exchanger 20 and the primary exchanger 26 define a main initial flow path that extends directly upward from the burner 18.

This movement of combustion products occurs because the hot combustion products are less dense than the cool room air flowing in at the lower end of the furnace. The flow from the upper end of the combustion chamber 25 flows through a narrowing section and into the primary exchanger 26. The combustion gases then flow backwardly towards the divider wall 37 and into a secondary exchanger 27. As seen by the arrow 47 of FIG. 5, the combustion gases flow downwardly in a first channel 32 of the secondary exchanger. The protrusions 34 of the divider wall 37 increase the turbulence of the flue gases as they flow. At the bottom of the primary channel 32, the flue gases then flow through the opening in the lower end of the secondary exchanger and upwardly in the second channel 33 of the secondary exchanger 27. From there, the combustion products flow upwardly into the draft hood 22 on their way to the flue 24.

The goal of the heat exchanger, of course, is to maximize heat transfer to the room. Room air is drawn in through the return 15 due to the heat given off by the exchanger. The cool room air 52 flows over the exterior surfaces of the heat exchanger sections. The air flows both in front of and behind the combustion chamber section 25. As the room air is heated, its density decreases and it flows upwardly. This creates a draft and induces further flow of the cool air 52 at the bottom of the exchanger. In the front of the exchanger, the heated air contacts lower deflector 42 and is deflected out into the room, as can be seen by arrows 54 of FIG. 5. In the back of the combustion chamber section, the second circulating current 56 contacts both the back of the combustion chamber and the secondary exchanger 27. It contacts deflector 43 at the top of the exchanger section and deflects out into the room, as can be seen by arrow 58 in FIG. 5. The deflectors 42 and 43 allow the front circulating air and back circulating air to circulate independently of each other.

The combustion gases that enter the draft hood 22 expand, thereby decreasing their temperature and increasing their pressure. Deflector 35 prevents the flue gases from flowing directly through the hood and into the flue 24. As can be seen from FIG. 2, cool ambient air shown by arrows 37 enters the draft hood from the sides, further decreasing the flue gas temperature.

In addition to the deflectors 42 and 43, a blower assembly 39 can also be used to further direct the heated air out into the room. The blower, which is placed in the front of the exchanger, does not interfere with the venting of cool ambient air into the draft hood since the vents are located on the sides of the draft hood.

Initial tests of the production form of the invention indicate that the efficiency of the heat exchanger illustrated is about 12% greater than that attained by earlier wall furnaces without secondary exchangers, side venting draft hoods or redirecting blowers. More specifically, prior gravity flow furnaces have a maximum thermal efficiency of approximately 70%. The addition of a secondary exchanger and side venting draft hood has increased the efficiency of the furnace to approximately 77–78%. In the terms of annual fuel utilization efficiency ("AFUE"), the prior AFUE was approximately 63–64%, whereas with the secondary exchanger and side venting draft hood, the AFUE has been found to be approximately 72%. The addition of a blower has been found to increase the overall efficiency by another percentage point. The blower also provides the additional advantages of decreased stratification of the heated and cooled air.

The side venting draft hood can also be used in conventional wall furnaces. Although the unit will not achieve the same degree of efficiency increase as with the secondary exchanger, the side venting draft hood will provide the inventive benefits of increased draft hood cooling and the optimum operation of a redirecting blower.

In conclusion, the present invention embodies several marked improvements over wall furnaces of the prior art. Furthermore, the present invention may be embodied in other specific forms without departing from its spirit or essential characteristics. The described embodiments are to be considered in all respects only as illustrative and not restrictive. The scope of the invention is, therefore, indicated by the independent claims rather than the foregoing description.

What is claimed is:

1. A gravity flow wall furnace comprising:

a front wall substantially parallel to, and facing, a room to be heated, the front wall having an inlet for the entrance of cool room air and an outlet for the exit of heated room air;

a back wall substantially parallel to the front wall;

two lateral walls extending from the front wall to the back wall and substantially perpendicular to the front wall, at least one of the lateral walls having an opening for the passage of air;

a combustion chamber located within the wall furnace comprising an elongated channel to contain the flow of combustion products and having an open lower end;

a burner located within the open lower end of the combustion chamber to feed the combustion products into said combustion chamber;

a primary heat exchanger comprising an elongated channel connected to, and extending upwardly from, the upper end of the combustion chamber, the primary heat exchanger containing the upward flow of combustion products;

a second heat exchanger comprising an elongated channel having a front side and a back side and located between the primary heat exchanger and the back wall of the furnace, the second heat exchanger connected to the upper end of the primary heat exchanger to contain the flow of combustion products from the primary heat exchanger, the second heat exchanger having a baffle extending within the second heat exchanger so as to receive combustion products from the primary heat exchanger and direct their flow downwardly toward the burner along a first flow path within the second exchanger, and upwardly away from the burner along a second flow path in the second heat exchanger;

the combustion chamber and the primary heat exchanger each having a front face that is substantially parallel to the front wall of the furnace, the front faces defining a first circuit between the front faces and the front wall of the furnace for the flow of room air to be heated by the front faces of the combustion chamber and primary heat exchanger as the air flows upward due to the effect of warm air rising;

a first deflector located above the primary heat from the cool room air inlet and exchanger and below a draft hood to direct air from the first circuit through the outlet and into the room;

the second heat exchanger being configured such that its front side is substantially parallel to the primary heat exchanger and its back side is substantially parallel to the back wall of the furnace to define a second circuit for room air to be heated by the second heat exchanger as it flows from the cool room air inlet and upward due to the effect of warm air rising;

a second deflector located above the first deflector and below the draft hood to direct air from the second circuit into the room and to insulate the draft hood from the second circuit air;

said first and second circuits of heated room air exiting the furnace through said outlet for the exit of heated room air and in two parallel substantially non-communicative segments, the first circuit exiting the furnace below the first deflector, and the second circuit exiting the furnace between the first and second deflectors; and said draft hood having a chamber to receive the combustion products from the second heat exchanger and to allow for expansion of the combustion products prior to their discharge to a flue, the draft hood located above the second deflector and having an inlet for the communication of combustion products from the second heat exchanger and an outlet for the exit of combustion products to the flue, the draft hood having a front face directed towards the front wall of the furnace and two lateral faces directed towards the lateral walls of the furnace, at least one of the lateral faces of the draft hood having an opening communicating with said opening of one of the lateral walls of the furnace for the intake of cool room air.

2. The gravity flow wall furnace of claim 1 wherein the first deflector comprises a plate oriented substantially perpendicular to the flow of heated air as it rises, the plate extending from the front face of the second exchanger so that it isolates heated air of the first circuit from the area between the first and second deflector.

3. The gravity flow wall furnace of claim 1 wherein the second deflector comprises a plate oriented substantially perpendicular to the flow of heated air as it rises, the plate extending from the back wall of the furnace and substantially around the second exchanger so that it isolates heated air from the second circuit from communicating with the draft hood.

4. The gravity flow wall furnace of claim 3 wherein the second deflector is spaced from the draft hood so that it creates an area of noncirculating air between the second deflector and the draft hood.

5. The gravity flow wall furnace of claim 1 wherein the combustion chamber, the primary heat exchanger, and the second heat exchanger each comprises a generally rectangular cross-sectional channel.

6. A gravity flow wall furnace comprising:

a front wall substantially parallel to, and facing, a room to be heated, the front wall having an inlet for the entrance of cool room air and an outlet for the exit of heated room air;

a back wall substantially parallel to the front wall;

two lateral walls extending from the front wall to a wall of a room to be heated and substantially perpendicular to the front wall of the furnace and the wall of the room to be heated, at least one of the lateral walls having an opening for the passage of air;

a combustion chamber located within the wall furnace comprising an elongated channel to contain the flow of combustion products and having an open lower end;

a burner located within the open lower end of the combustion chamber to feed the combustion products into said combustion chamber;

a primary heat exchanger comprising an elongated channel connected to, and extending upwardly from, the upper end of the combustion chamber, the primary heat exchanger containing the upward flow of combustion products;

a second heat exchanger comprising an elongated channel having a front side and a back side and located between the primary heat exchanger and the back wall of the furnace, the second heat exchanger connected to the upper end of the primary heat exchanger to contain the flow of combustion products from the primary heat exchanger, the second heat exchanger having a baffle extending within the second heat exchanger so as to receive combustion products from the primary heat exchanger and direct their flow downwardly toward the burner along a first flow path within the second exchanger, and upwardly away from the burner along a second flow path in the second heat exchanger;

the combustion chamber and the primary heat exchanger each having a front face that is substantially parallel to the front wall of the furnace, the front faces defining a first circuit between the front faces and the front wall of the furnace for the flow of room air to be heated by the front faces of the combustion chamber and primary heat exchanger as the air flows from the cool room air inlet and upward due to the effect of warm air rising;

a first deflector located above the primary heat exchanger and below a draft hood to direct air from the first circuit through the outlet and into the room;

the second heat exchanger being configured such that its front side is substantially parallel to the primary heat exchanger and its back side is substantially parallel to the back wall of the furnace to define a second circuit for room air to be heated by the second heat exchanger as it flows from the cool room air inlet and upward due to the effect of warm air rising;

a second deflector located above the first deflector and below the draft hood to direct air from the second circuit into the room and to insulate the draft hood from the second circuit air;

said first and second circuits of heated room air exiting the furnace through said outlet for the exit of heated room air and in two parallel substantially non-communicative segments, the first circuit exiting the furnace below the first deflector, and the second circuit exiting the furnace between the first and second deflectors; and said draft hood having a chamber to receive the combustion products from the second heat exchanger and to allow for expansion of the combustion products prior to their discharge to a flue, the draft hood located above the second deflector and having an inlet for the communication of combustion products from the second heat exchanger and an outlet for the exit of combustion products to the flue, the draft hood extending beyond the wall of the room to be heated and having a front face directed towards the front wall of the furnace and two lateral faces directed towards the lateral walls of the furnace, at least one of the lateral faces of the draft hood having an opening communicating with said opening for the passage of air for the intake of cool room air, the opening located on a portion of the draft hood extending within the room to be heated.

7. The gravity flow wall furnace of claim 6 wherein the opening of one of the lateral walls of the furnace is aligned with the opening of one of the lateral faces of the draft hood.

8. The gravity flow wall furnace of claim 6 wherein the first deflector comprises a plate oriented substantially perpendicular to the flow of heated air as it rises, the plate extending from the front face of the second exchanger so that it isolates heated air of the first circuit from the area between the first and second deflector.

9. The gravity flow wall furnace of claim 6 wherein the second deflector comprises a plate oriented substantially perpendicular to the flow of heated air as it rises, the plate extending from the back wall of the furnace and substantially around the second exchanger so that it isolates heated air from the second circuit from communicating with the draft hood.

10. The gravity flow wall furnace of claim 9 wherein the second deflector is spaced from the draft hood so that it creates an area of noncirculating air between the second deflector and the draft hood.

11. The gravity flow wall furnace of claim 6 wherein the combustion chamber, the primary heat exchanger, and the second heat exchanger each comprise a generally rectangular cross-sectional channel.

12. A gravity flow wall furnace comprising:

a front wall substantially parallel to, and facing, a room to be heated, the front wall having an inlet for the entrance of cool room air and an outlet for the exit of heated room air;

a back wall substantially parallel to the front wall;

two lateral walls extending from the front wall to the back wall and substantially perpendicular to the front wall, at least one of the lateral walls having an opening for the passage of air;

a combustion chamber located within the wall furnace comprising an elongated channel to contain the flow of combustion products and having an open lower end;

a burner located within the open lower end of the combustion chamber to feed the combustion products into said combustion chamber;

a primary heat exchanger comprising an elongated channel connected to, and extending upwardly form, the upper end of the combustion chamber, the primary heat exchanger containing the upward flow of combustion products;

a second heat exchanger comprising an elongated channel having a front side and a back side and located between the primary heat exchanger and the back wall of the furnace, the second heat exchanger connected to the upper end of the primary heat exchanger to contain the flow of combustion products from the primary heat exchanger, the second heat exchanger having a baffle extending within the second heat exchanger so as to receive combustion products from the primary heat exchanger and direct their flow downwardly toward the burner along a first flow path within the second exchanger, and upwardly away from the burner along a second flow path in the second heat exchanger;

the combustion chamber and the primary heat exchanger each having a front face that is substantially parallel to the front wall of the furnace, the front faces defining a first circuit between the front faces and the front wall of the furnace for the flow of room air to be heated by the front faces of the combustion chamber and primary heat exchanger as the air flows from the cool room air inlet and upward due to the effect of warm air rising;

a first deflector located above the primary heat exchanger and below a draft hood to direct air from the first circuit through the outlet and into the room;

the second heat exchanger being configured such that its front side is substantially parallel to the primary heat exchanger and its back side is substantially parallel to the back wall of the furnace to define a second circuit for room air to be heated by the second heat exchanger as it flows from the cool room air inlet and upward due to the effect of warm air rising;

a second deflector located above the first deflector and below the draft hood to direct air from the second circuit into the room and to insulate the draft hood from the second circuit air;

said first and second circuits of heated room air exiting the furnace through said outlet for the exit of heated room air and in two parallel substantially non-communicative segments, the first circuit exiting the furnace below the first deflector, and the second circuit exiting the furnace between the first and second deflectors; and said draft hood having a chamber to receive the combustion products from the second heat exchanger and to allow for expansion of the combustion products prior to their discharge to a flue, the draft hood located above the second deflector and having an inlet for the communication of combustion products from the second heat exchanger and an outlet for the exit of combustion products to the flue, the draft hood having a front face directed towards the front wall of the furnace and two lateral faces directed towards the lateral walls of the furnace, the draft hood having an opening communicating with said opening for the passage of air on a face other than the front face to allow for the intake of air from the room such that the air being taken in is cooler than room air adjacent the front face of the draft hood.

13. The gravity flow wall furnace of claim 12 wherein the draft hood has an opening on at least of its lateral faces.

14. The gravity flow wall furnace of claim 12 wherein the first deflector comprises a plate oriented substantially perpendicular to the flow of heated air as it rises, the plate extending from the front face of the second exchanger so that it isolates heated air of the first circuit from the area between the first and second deflector.

15. The gravity flow wall furnace of claim 12 wherein the second deflector comprises a plate oriented substantially perpendicular to the flow of heated air as it rises, the plate extending from the back wall of the furnace and substantially around the second exchanger so that it isolates heated air from the second circuit from communicating with the draft hood.

16. The gravity flow wall furnace of claim 15 wherein the second deflector is spaced from the draft hood so that it creates an area of noncirculating air between the second deflector and the draft hood.

17. The gravity flow wall furnace of claim 12 wherein the combustion chamber, the primary heat exchanger, and the second heat exchanger each comprise a generally rectangular cross-sectional channel.

* * * * *

UNITED STATES PATENT AND TRADEMARK OFFICE

CERTIFICATE OF CORRECTION

PATENT NO. : 5,368,012

DATED : November 29, 1994

INVENTOR(S) : Chamberlain

It is certified that error appears in the above-indentified patent and that said Letters Patent is hereby corrected as shown below:

Column 5, line 57, after "side louvres", delete "3,"

Column 8, line 66, after "which", add --is--

Column 10, line 67, after "air flows", add --from the cool room air inlet and--

Column 11, line 1, after "heat", delete "from the cool room air inlet and"

Column 13, line 57, change "form" to "from"

Signed and Sealed this

Sixth Day of June, 1995

*Attest:*

*Attesting Officer*

Bruce Lehman

BRUCE LEHMAN

*Commissioner of Patents and Trademarks*